US011794307B2

(12) United States Patent
Moren et al.

(10) Patent No.: US 11,794,307 B2
(45) Date of Patent: Oct. 24, 2023

(54) LARGE DENIER NONWOVEN FIBER WEBS

(71) Applicant: 3M INNOVATIVE PROPERTIES COMPANY, St. Paul, MN (US)

(72) Inventors: Louis S. Moren, Oakdale, MN (US); Scott M. Mevissen, White Bear Lake, MN (US); Gregory G. Mehsikomer, Maplewood, MN (US); Shawn C. Bell, Cottage Grove, MN (US); Gary T. Stram, Prairie Du Chein, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 513 days.

(21) Appl. No.: 16/608,215

(22) PCT Filed: Apr. 20, 2018

(86) PCT No.: PCT/IB2018/052774
§ 371 (c)(1),
(2) Date: Oct. 25, 2019

(87) PCT Pub. No.: WO2018/198004
PCT Pub. Date: Nov. 1, 2018

(65) Prior Publication Data

US 2020/0190714 A1 Jun. 18, 2020

Related U.S. Application Data

(60) Provisional application No. 62/555,870, filed on Sep. 8, 2017, provisional application No. 62/491,619, filed on Apr. 28, 2017.

(51) Int. Cl.
*B24D 3/00* (2006.01)
*B24D 11/00* (2006.01)
(Continued)

(52) U.S. Cl.
CPC ..... *B24D 3/004* (2013.01); *B24D 11/001* (2013.01); *D04H 1/413* (2013.01);
(Continued)

(58) Field of Classification Search
CPC ..... D04H 1/413; D04H 1/43912; D04H 1/43918; D04H 1/498; D04H 1/64; D04H 1/732; D04H 1/74
See application file for complete search history.

(56) References Cited

U.S. PATENT DOCUMENTS 4,227,350 A 10/1980 Fitzer
4,893,439 A 1/1990 McAvoy
(Continued)

FOREIGN PATENT DOCUMENTS

EP 0287286 * 10/1988 ..... B24D 11/001
EP 1140427 10/2001
(Continued)

OTHER PUBLICATIONS

International Search Report for PCT International Application No. PCT/IB2018/052774, dated Jun. 18, 2018, 6 pages.

*Primary Examiner* — Lynda Salvatore
(74) *Attorney, Agent, or Firm* — Katherine M. Scholz

(57) ABSTRACT

Various embodiments disclosed relate to an abrasive article. The abrasive article includes a nonwoven web. The nonwoven web includes a first irregular major surface and an opposite second irregular major surface. The nonwoven web further includes a fiber component comprising staple fibers having a linear density ranging from about 50 denier to about 2000 denier and a crimp index value ranging from about 15% to about 60%. The nonwoven web further includes a binder dispensed on the fiber component and abrasive particles dispersed throughout the nonwoven web.

15 Claims, 1 Drawing Sheet

(51) Int. Cl.

| | |
|---|---|
| ***D04H 1/413*** | (2012.01) |
| ***D04H 1/498*** | (2012.01) |
| ***D04H 1/64*** | (2012.01) |
| ***D04H 1/74*** | (2006.01) |
| ***D04H 1/4391*** | (2012.01) |

(52) U.S. Cl.
CPC ..... *D04H 1/43912* (2020.05); *D04H 1/43918* (2020.05); *D04H 1/498* (2013.01); *D04H 1/64* (2013.01); *D04H 1/74* (2013.01)

(56) References Cited

U.S. PATENT DOCUMENTS

| | | | | |
|---|---|---|---|---|
| 5,282,900 | A | 2/1994 | McDonell | |
| 5,685,935 | A | 11/1997 | Heyer | |
| 5,919,549 | A | 7/1999 | Van | |
| 6,302,930 | B1 | 10/2001 | Lux | |
| 6,312,484 | B1 | 11/2001 | Chou | |
| 6,352,567 | B1 | 3/2002 | Windisch | |
| 7,358,203 | B1 | 4/2008 | Prickett | |
| 8,142,531 | B2 | 3/2012 | Adefris | |
| 8,734,205 | B2 | 5/2014 | Goldsmith | |
| 8,992,643 | B2 | 3/2015 | Herbert | |
| 2005/0223649 | A1 | 10/2005 | O'Gary | |
| 2009/0038102 | A1 | 2/2009 | Roque | |
| 2010/0092746 | A1 | 4/2010 | Coant | |
| 2013/0012112 | A1 | 1/2013 | Hsu | |
| 2014/0080393 | A1 | 3/2014 | Ludwig | |
| 2014/0259960 | A1* | 9/2014 | Rotter | B24D 11/005 51/307 |
| 2015/0018390 | A1 | 1/2015 | Wohabrebbi | |
| 2016/0008957 | A1 | 1/2016 | Kaur | |
| 2016/0052106 | A1 | 2/2016 | Woo | |

FOREIGN PATENT DOCUMENTS

| | | |
|---|---|---|
| JP | 2003278072 | 10/2003 |
| WO | WO 1994-04738 | 3/1994 |
| WO | WO 1997-049326 | 12/1997 |
| WO | WO 2014-137972 | 9/2014 |

* cited by examiner

LARGE DENIER NONWOVEN FIBER WEBS

CROSS REFERENCE TO RELATED APPLICATIONS

This application is a national stage filing under 35 U.S.C. 371 of PCT/IB2018/052774, filed Apr. 20, 2018, which claims the benefit of U.S. Provisional Application No. 62/555,870 filed Sep. 8, 2017, and U.S. Provisional Application No. 62/491,619 filed Apr. 28, 2017, the disclosure of which is incorporated by reference in its entirety herein.

BACKGROUND

Nonwoven abrasive articles generally have a nonwoven web (e.g., a lofty open fibrous web), abrasive particles, and a binder material (commonly termed a "binder") that bonds the fibers within the nonwoven web to each other and secures the abrasive particles to the nonwoven web. To increase the abrading ability of the article and to streamline production of the article properties of the fibers can be altered.

SUMMARY OF THE DISCLOSURE

There are several unexpected advantages associated with the articles and methods according to various embodiments of the present disclosure. For example, according to some embodiments nonwoven webs made with comparatively small denier fibers (e.g., less than 200 denier), comparatively large denier fibers (e.g., greater than 500 denier), or 50-2000 denier fibers without selection of specific fiber lengths and fiber crimp, produces webs that do not have sufficient strength to survive normal web transfer points and coating processes. According to some embodiments, nonwoven webs having at least one of the disclosed fibers sizes, length, and/or crimp index can allow for the manufacture of tough abrasive webs suitable for scale removal, paint stripping, and rust removal. According to some examples, fibers having the length, crimp index, and liner density values described herein can lead to minimal fiber clogging of the web-forming machine than fibers differing in any one of those dimensions during formation of the abrasive article. The reduction of clogging in the machine leads to savings in time and cost in preparing the abrasive article.

The present disclosure provides an abrasive article. The abrasive article includes a nonwoven web. The nonwoven web includes a first irregular major surface and an opposite second irregular major surface. The nonwoven web further includes a fiber component having staple fibers having a linear density ranging from about 50 denier to about 2000 denier and a crimp index value ranging from about 15% to about 60%. The nonwoven web further includes a binder dispensed on the fiber component and abrasive particles dispersed throughout the nonwoven web.

The present disclosure further provides a method of making the abrasive article. The abrasive article includes a nonwoven web. The nonwoven web includes a first irregular major surface and an opposite second irregular major surface. The nonwoven web further includes a fiber component comprising staple fibers having a linear density ranging from about 50 denier to about 2000 denier and a crimp index value ranging from about 15% to about 60%. The nonwoven web further includes a binder dispensed on the fiber component and abrasive particles dispersed throughout the nonwoven web. The method includes forming a web of the staple fibers. The method further includes perforating the web and applying the abrasive particles to the perforated web. The method further includes curing the binder including the abrasive particles to provide the abrasive article.

The present disclosure further provides a method for removing material from the surface of a workpiece. The method includes contacting an abrasive article against the workpiece. The abrasive article includes a nonwoven web. The nonwoven web includes a first irregular major surface and an opposite second irregular major surface. The nonwoven web further includes a fiber component comprising staple fibers having a linear density ranging from about 50 denier to about 2000 denier and a crimp index value ranging from about 15% to about 60%. The nonwoven web further includes a binder dispensed on the fiber component and seeping through the component. The nonwoven web further includes abrasive particles dispersed homogenously or heterogeneously throughout the nonwoven web. A method of forming the article includes forming a web of the staple fibers. The method further includes perforating the web and applying the abrasive particles to the perforated web. The method further includes curing the binder of the web including the abrasive particles to provide the abrasive article. The method of removing the material further includes moving the abrasive article relative to the workpiece while maintaining pressure between the abrasive article and the workpiece surface to remove material therefrom.

The present disclosure further includes an abrasive article. The abrasive article includes a nonwoven web. The nonwoven web includes a first irregular major surface and an opposite second irregular major surface. The nonwoven web includes a fiber component comprising a blend of first staple fibers having a linear density ranging from about 50 denier to about 600 denier and second staple fibers having a linear density ranging from about 400 denier to about 1000 denier. The nonwoven web further includes abrasive particles distributed on the fiber component. The nonwoven web further includes a binder distributed on the fiber component.

According to some embodiments, the nonwoven web is very open in nature allowing large grit minerals to penetrate the entire thickness of the nonwoven web. Examples of suitable grit sizes can range from about 16 grit to about 80 grit, about 20 grit to about 70 grit, less than, equal to, or greater than about, 16 grit, 18, 20, 22, 24, 26, 28, 30, 32, 34, 36, 38, 40, 42, 44, 46, 48, 50, 52, 54, 56, 58, 60, 62, 64, 66, 68, 70, 72, 74, 76, 78, or 80 grit. According to some embodiments, nonwoven webs formed with fibers differing in at least one of linear density, length, and/or crimp index can degrade significantly or completely during processing or become knotted during manufacture, which can result in a stoppage of manufacturing equipment due to fiber entanglement or clogging in the equipment. According to some embodiments, the abrasive articles have a degree of porosity that can substantially prevent clogging of material during use. According to some embodiments, the abrasive articles can include tensilized nylon fibers that impart high tear strength values to the article, thus improving the durability of the article. According to some embodiments the crimp index of the fiber gives the abrasive article a lofty structure.

According to some embodiments, abrasive articles are not irreversibly compressed during curing in the course of manufacture. This can result in opposed major (e.g., largest) surfaces of the abrasive article having an irregular or substantially non-planar contour. According to some embodiments, this can increase the contact area between the abrasive article and a workpiece. This can be because the abrasive article is able to be reversibly compressed and thus expand in area upon contact with a working surface in contrast to a corresponding abrasive article having substantially the same dimensions but being irreversibly compressed during manufacture. Additionally, according to some embodiments, by not irreversibly compressing the abrasive article during or after curing of the binder, the major surfaces are substantially free of planar agglomerations of fibers that are formed by fusion of the fibers during compression. By being substantially free of these planar agglomerations, there can be increased mineral exposure on the nonagglomerated fibers, which can result in increased performance of the article. According to some embodiments, the irregular contour of the major surfaces can increase the surface roughness of those surfaces compared to a corresponding abrasive article with a planar surface.

BRIEF DESCRIPTION OF THE FIGURES

The drawings illustrate generally, by way of example, but not by way of limitation, various embodiments discussed in the present document.

DETAILED DESCRIPTION

Figure 1:
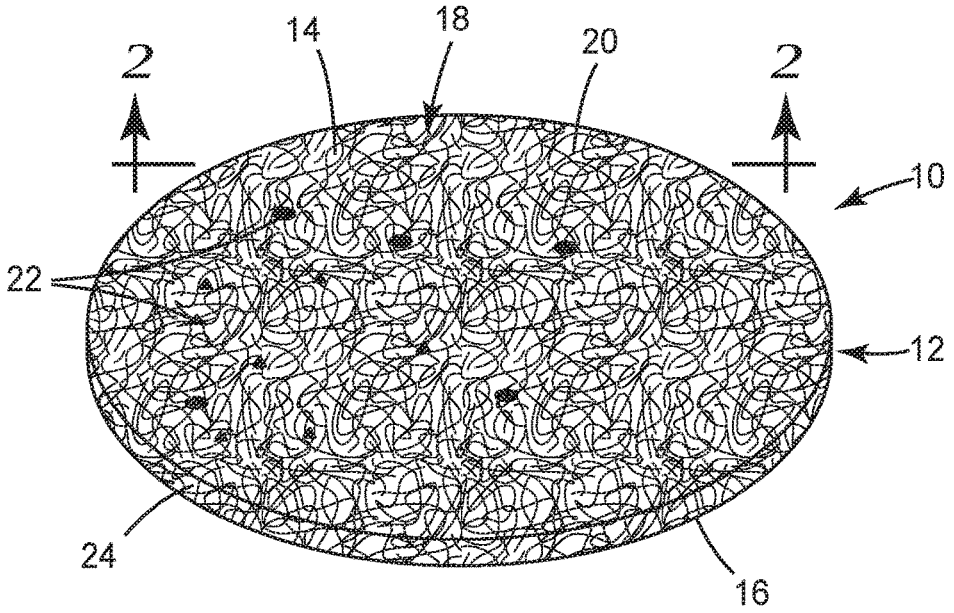
FIG. 1 is a perspective view of an abrasive article.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the disclosure, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%.

As used herein "formed abrasive particle" means an abrasive particle having a predetermined or non-random shape. One process to make a formed abrasive particle such as a formed ceramic abrasive particle includes shaping the precursor ceramic abrasive particle in a mold having a predetermined shape to make ceramic shaped abrasive particles. Ceramic shaped abrasive particles, formed in a mold, are one species in the genus of formed ceramic abrasive particles. Other processes to make other species of formed ceramic abrasive particles include extruding the precursor ceramic abrasive particle through an orifice having a predetermined shape, printing the precursor ceramic abrasive particle through an opening in a printing screen having a predetermined shape, or embossing the precursor ceramic abrasive particle into a predetermined shape or pattern. In other examples, the formed ceramic abrasive particles can be cut from a sheet into individual particles. Examples of suitable cutting methods include mechanical cutting, laser cutting, or water-jet cutting. Non-limiting examples of formed ceramic abrasive particles include shaped abrasive particles, such as triangular plates, or elongated ceramic rods/filaments. Formed ceramic abrasive particles are generally homogenous or substantially uniform and maintain their sintered shape without the use of a binder such an organic or inorganic binder that bond smaller abrasive particles into an agglomerated structure and excludes abrasive particles obtained by a crushing or comminution process that produces abrasive particles of random size and shape. In many embodiments, the formed ceramic abrasive particles comprise a homogeneous structure of sintered alpha alumina or consist essentially of sintered alpha alumina.

Figure 2:
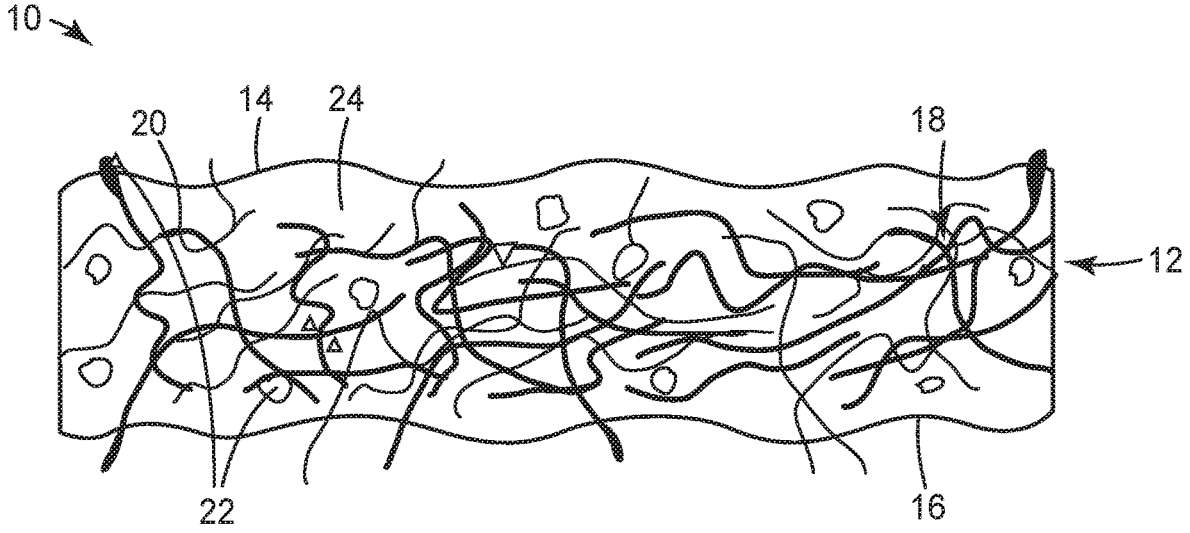
FIG. 2 is a sectional view of the abrasive article of FIG. 1 taken along section line 2-2.

FIG. 1 is a perspective view of abrasive article 10. FIG. 2 is a sectional view of the abrasive article of FIG. 1 taken along section line 2-2. FIGS. 1 and 2 show substantially the same components and are discussed concurrently. As shown in FIGS. 1 and 2, the abrasive article includes a nonwoven web 12. The nonwoven web includes first major surface 14 and opposite second major surface 16. Each of the first major surface and the second major surface have an irregular or substantially non-planar profile. The nonwoven web includes fiber component 18, which includes individual fibers 20. Abrasive particles 22, which are dispersed throughout the nonwoven web and binder 24 adheres the abrasive particles to the individual fibers.

While not so limited, the fiber component can range from about 5 wt % to about 30 wt % of the abrasive article, about 10 wt % to about 25 wt %, about 10 wt % to about 20 wt %, about 12 wt % to about 15 wt %, less than, equal to, or greater than about 5 wt %, 10, 15, 20, 25, or 30 wt %. The fiber component can include a plurality of individual fibers that are randomly oriented and entangled with respect to each other. The individual fibers are bonded to each other at points of mutual contact. The individual fibers can be staple fibers or continuous fibers. As generally understood, "staple fiber" refers to a fiber of a discrete length and "continuous fiber" refers to a fiber that can be a synthetic filament. The individual fibers can range from about 70 wt % to about 100 wt % of the fiber component, about 80 wt % to about 90 wt %, less than, equal to, or greater than about 70 wt %, 75, 80, 85, 90, 95, or 100 wt % of the fiber component.

The individual staple fibers can have a length ranging from about 35 mm to 155 mm 50 mm to about 105 mm, about 70 mm to about 80 mm, less than, equal to, or greater than about 35 mm, 40, 45, 50, 55, 60, 65, 70, 75, 76, 80, 85, 90, 95, 100, 102, 105, 110, 115, 120, 125, 130, 135, 140, 145, 150, or 155 mm. A crimp index value of the individual staple fibers can range from about 15% to about 60%, about 20% to about 50%, less than, equal to, or greater than about 15%, 20, 25, 30, 35, 40, 45, 50, 55, or 60%. Crimp index is a measurement of a produced crimp; e.g., before appreciable crimp is induced in the fiber. The crimp index is expressed as the difference in length of the fiber in an extended state minus the length of the fiber in a relaxed (e.g., shortened) state divided by the length of the fiber in the extended state. The staple fibers can have a fineness or linear density ranging from about 50 denier to about 2000 denier, about 50 denier to about 700 denier, about 50 denier to about 600 denier, less than, equal to, or greater than about 200 denier, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1600, 1650, 1700, 1750, 1800, 1850, 1900, 1950, 2000 denier.

In some examples, the fiber component can include a blend of staple fibers. For example, the fiber component can include a first plurality of individual fibers and a second plurality of individual staple fibers. The first and second pluralities of staple fibers of the blend can differ with respect to at least one of linear density value, crimp index, or length. For example, a linear density of the individual staple fibers of the first plurality of individual fibers can range from about 20 denier to about 120 denier, about 40 denier to about 100 denier, or about 50 to about 90. A linear density of the individual staple fibers of the second plurality of individual fibers can range from about 300 denier to about 2000 denier, about 400 denier to about 1000 denier, or about 400 denier to about 600 denier. Blends of individual staple fibers with differing linear densities can be useful, for example, to provide an abrasive article that upon use can result in a desired surface finish. The length or crimp index of any of the individual fibers can be in accordance with the values discussed herein.

In examples of the abrasive article including blends of individual staple fibers the first and second pluralities of individual staple fibers can account for different portions of the fiber component. For example, the first plurality of individual fibers can range from about 5 wt % to about 80 wt % of the fiber component, about 5 wt % to about 40 wt %, less than, equal to, or greater than about 20 wt %, 25, 30, 35, 40, 45, 50, 55, 60, 65, 70, 75, or 80 wt %. The second plurality of individual fibers can range from about 40 wt % to about 95 wt % of the fiber component, about 60 wt % to about 95 wt %, less than, equal to, or greater than about 20 wt %, 25, 30, 35, 40, 45, 50, 55, 60, 65, 70, 75, or 80 wt %. While two pluralities of individual staple fibers are discussed herein, it is within the scope of this disclosure to include additional pluralities of individual staples fibers such as a third plurality of individual staple fibers that differs with respect to at least one of liner density value, crimp index, and/or length of the first and second pluralities of individual fibers.

The fibers of the nonwoven web can include many suitable materials. Factors influencing the choice of material include whether the material is suitably compatible with adhering binders and abrasive particles while also being processable in combination with other components of the abrasive article, and the material's ability to withstand processing conditions (e.g., temperatures) such as those employed during application and curing of the binder. The materials of the fibers can also be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., nylon-6,6, polycaprolactam), polypropylene, acrylonitrile (e.g., acrylic), rayon, cellulose acetate, polyvinylidene chloride-vinyl chloride copolymer, and vinyl chloride-acrylonitrile copolymer. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers can be tensilized and crimped staple fibers.

In some examples, the individual fibers can have a non-circular cross sectional shape or blends of individual fibers having a circular and a non-circular cross sectional shape (e.g., triangular, delta, H-shaped, tri-lobal, rectangular, square, dog bone, ribbon-shaped, or oval).

The abrasive article includes an abrasive component adhered to the individual fibers. The abrasive particles can range from about 5 wt % to about 70 wt % of the abrasive article, about 40 wt % to about 60 wt %, less than, equal to, or greater than about 5 wt %, 10, 15, 20, 25, 30, 35, 40, 45, 50, 55, 60, 65, or 70 wt %. The abrasive component can include individual abrasive particles.

There are many types of useful abrasive particles that can be included in the abrasive article including formed ceramic abrasive particles (including formed ceramic abrasive particles) and conventional abrasive particles. The abrasive component can include only formed abrasive particles or conventional abrasive particles. The abrasive component can also include blends of formed abrasive particles or conventional abrasive particles. For example, the abrasive component can include a blend of about 5 wt % to about 95 w % formed abrasive particles, about 10 wt % to about 50 wt % formed abrasive particles, less than, equal to, or greater than about 5 wt %, 10, 15, 20, 25, 30, 35, 40, 45, 50, 55, 60, 65, 70, 75, 80, 85, 90, or 95 wt % formed abrasive particles with the balance being conventional abrasive particles. As another example, the abrasive component can include a blend of about 5 wt % to about 95 wt % conventional abrasive particles, about 30 wt % to about 70 wt % conventional abrasive particles, less than, equal to, or greater than about 5 wt %, 10, 15, 20, 25, 30, 35, 40, 45, 50, 55, 60, 65, 70, 75, 80, 85, 90, or 95 wt % conventional abrasive particles with the balance being formed abrasive particles.

The abrasive particles can be applied to the fibers as individual abrasive particles (e.g., particles not held together with a binder and applied to the fibers) or as agglomerates (e.g., particles held together with a binder and applied to the fibers).

Formed or shaped abrasive particles can be prepared by shaping alumina sol gel from, for example, equilateral triangle-shaped polypropylene mold cavities. After drying and firing, such resulting shaped abrasive particles can have a triangular shape having a long dimension of about 100 μm to about 2500 μm about 100 μm to about 1400 μm, about 300 μm to about 1400 μm, less than, equal to, or greater than about 100 μm, 200, 300, 400, 500, 600, 700, 800, 900, 1000, 1100, 1200, 1300, 1400, 1500, 1600, 1700, 1800, 1900, 2000, 2100, 2200, 2300, or 2400 μm.

In some examples, the triangular shaped abrasive particles include a first face and an opposing second face connected to the first face by a sidewall where the perimeter of each face is a triangular (e.g., an equilateral triangle). In some embodiments, the sidewall, instead of having a 90 degree angle to both faces, is a sloping sidewall having a draft angle a between the second face and the sloping sidewall between about 95 degrees to about 130 degrees, which has been determined to greater enhance the cut rate of the triangular shaped abrasive particles.

The abrasive article can also include conventional (e.g., crushed) abrasive particles. Examples of useful conventional abrasive particles include any abrasive particles known in the abrasive art. Examples of useful abrasive particles include fused aluminum oxide based materials such as aluminum oxide, ceramic aluminum oxide (which can include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof.

The conventional abrasive particles can, for example, have an average particle size ranging from about 10 μm to about 2000 μm, about 20 μm to about 1300 μm, about 50 μm to about 1000 μm, less than, equal to, or greater than about 10 μm, 20, 30, 40, 50, 100, 150, 200, 250, 300, 350, 400, 450, 500, 550, 600, 650, 700, 750, 800, 850, 900, 950, 1000, 1050, 1100, 1150, 1200, 1250, 1300, 1350, 1400, 1450, 1500, 1550, 1650, 1700, 1750, 1800, 1850, 1900, 1950, or 2000 μm. For example, the conventional abrasive particles can have an abrasives industry specified nominal grade. Such abrasives industry accepted grading standards include those known as the American National Standards Institute, Inc. (ANSI) standards, Federation of European Producers of Abrasive Products (FEPA) standards, and Japanese Industrial Standard (HS) standards. Exemplary ANSI grade designations (i.e., specified nominal grades) include: ANSI 12 (1842 μm), ANSI 16 (1320 μm), ANSI 20 (905 μm), ANSI 24 (728 μm), ANSI 36 (530 μm), ANSI 40 (420 μm), ANSI 50 (351 μm), ANSI 60 (264 μm), ANSI 80 (195 μm), ANSI 100 (141 μm), ANSI 120 (116 μm), ANSI 150 (93 μm), ANSI 180 (78 μm), ANSI 220 (66 μm), ANSI 240 (53 μm), ANSI 280 (44 μm), ANSI 320 (46 μm), ANSI 360 (30 μm), ANSI 400 (24 μm), and ANSI 600 (16 μm). Exemplary FEPA grade designations include P12 (1746 μm), P16 (1320 μm), P20 (984 μm), P24 (728 μm), P30 (630 μm), P36 (530 μm), P40 (420 μm), P50 (326 μm), P60 (264 μm), P80 (195 μm), P100 (156 μm), P120 (127 μm), P120 (127 μm), P150 (97 μm), P180 (78 μm), P220 (66 μm), P240 (60 μm), P280 (53 μm), P320 (46 μm), P360 (41 μm), P400 (36 μm), P500 (30 μm), P600 (26 μm), and P800 (22 μm). An approximate average particles size of reach grade is listed in parenthesis following each grade designation.

Filler particles can also be included in the abrasive component. Examples of useful fillers include metal carbonates (such as calcium carbonate, calcium magnesium carbonate, sodium carbonate, magnesium carbonate), silica (such as quartz, glass beads, glass bubbles and glass fibers), silicates (such as talc, clays, montmorillonite, feldspar, mica, calcium silicate, calcium metasilicate, sodium aluminosilicate, sodium silicate), metal sulfates (such as calcium sulfate, barium sulfate, sodium sulfate, aluminum sodium sulfate, aluminum sulfate), gypsum, vermiculite, sugar, wood flour, aluminum trihydrate, carbon black, metal oxides (such as calcium oxide, aluminum oxide, tin oxide, titanium dioxide), metal sulfites (such as calcium sulfite), thermoplastic particles (such as polycarbonate, polyetherimide, polyester, polyethylene, poly(vinylchloride), polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles and the like). The filler may also be a salt such as a halide salt. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metal fillers include, tin, lead, bismuth, cobalt, antimony, cadmium, iron and titanium. Other miscellaneous fillers include sulfur, organic sulfur compounds, graphite, lithium stearate and metallic sulfides.

The abrasive article can be made by forming a nonwoven web and applying adhesive to fibers. A make coat can be applied to the nonwoven web. The nonwoven web can be rolled to substantially lay at least some fibers flat that protrude from the web. Abrasive particles can be applied to the make coat to form a nonwoven abrasive web. The make coat is cured and a size coat is applied over the make coat, which is subsequently cured to form the abrasive article.

The nonwoven web can be manufactured, for example, by conventional air laid, carded, stitch bonded, spun bonded, wet laid, and/or melt blown procedures. Air laid nonwoven webs can be prepared using a web-forming machine such as, for example, that available under the trade designation "RANDO WEBBER" commercially available from Rando Machine Company of Macedon, N.Y. The web can also be perforated. In some examples, perforating the web can include needle punching the web.

The nonwoven abrasive web is prepared by adhering the abrasive particles to a nonwoven web with a curable second binder. Binders useful for adhering the abrasive particles to the nonwoven web can be selected according to the final product requirements. Examples of binders include those comprising polyurethane resin, phenolic resin, acrylate resin, and blends of phenolic resin and acrylate resin. The coating weight for the abrasive particles can depend, for example, on the particular binder used, the process for applying the abrasive particles (e.g., drop coating), and the size of the abrasive particles. For example, the coating weight of the abrasive particles on the nonwoven web can be 100 grams per square meter ($g/m^2$) to about 5000 $g/m^2$, about 1500 $g/m^2$ to about 5000 $g/m^2$ about 2000 $g/m^2$ to about 4000 $g/m^2$, less than, equal to, or greater than about 100 $g/m^2$, 200, 300, 400, 500, 600, 700, 800, 900, 1000, 1100, 1200, 1300, 1400, 1500, 1600, 1700, 1800, 1900, 2000, 2100, 2200, 2300, 2400, 2500, 2600, 2700, 2800, 2900, 3000, 3100, 3200, 3300, 3400, 3500, 3600, 3700, 3800, 3900, 4000, 4100, 4200, 4300, 4400, 4500, 4600, 4700, 4800, 4900, or 5000 $g/m^2$. The abrasive particles can be coated on either or both of the first and second major surfaces of the nonwoven web. The abrasive particles can be coated to achieve a substantially uniform distribution of abrasive particles throughout the web.

Some abrasive articles are formed by pressing at least one plate (e.g., a metal plate) against the web during curing of the binder. A measure of compression can be in the form of a compression ratio. The compression ratio is the result of 1−(d(compressed)/d(uncompressed)) expressed in percentage, in which d(compressed) and d(uncompressed) designate the thickness or density in $g/cm^3$ of the compressed or uncompressed abrasive article. The abrasive nonwoven web of the instant disclosure is not compressed by pressing a plate against the web during or after curing of the binder or at least any compression ratio imparted to the abrasive nonwoven web does not exceed 10%.

Compression of the abrasive nonwoven during or after curing of the binder can result in the abrasive article having a reduced thickness compared to the non-compressed state. This also can result in the external surfaces of the abrasive article having a substantially planar (e.g., flat) profile. Additionally, compression can result in a plurality of planar agglomerations of fibers being formed at the external surfaces. Planar agglomerations of the fibers are associations between fibers where bonding multiple fibers are fused together and compressed to form a planar agglomerate.

This is different from the more discrete individual points of contact between the fibers of the non-compressed nonwoven web of the instant disclosure where the article is not compressed during or after curing of the binder. When the fibers are fused together to form the planar agglomerates, those agglomerated portions of the fibers are not available to abrade a surface of a workpiece. Additionally those planar agglomerations can make it difficult for an abraded material to enter the abrasive article, which can result in more abrasive product being located on the article and potentially preventing a portion of the fibers from contacting the surface of the workpiece. Additionally, the substantial lack of these planar agglomerates, and planar surface, increases the surface roughness and abrasive partial exposure of the disclosed abrasive articles compared to the compressed abrasive articles. Additionally, compression during or after curing of the binder can substantially prevent an abrasive article from rebounding to a pre-compression thickness. The article of the instant disclosure is reversibly compressible such that it can expand on contact with a working surface and thus have a higher surface area than a corresponding article that is compressed during or after curing of the binder. All of these characteristics can result in the disclosed abrasive article having a higher cut than a corresponding abrasive article compressed during or after curing of the binder.

The abrasive article can be used to remove a material from a surface of a workpiece. This can be accomplished by contacting a surface of the abrasive article against the workpiece. The workpiece can be contacted, for example, at a force ranging from about 1 newton to about 40 newtons. The abrasive article can then be moved (e.g., rotated) relative to workpiece, while maintaining a pressure between the abrasive article and the workpiece surface. While the abrasive article can have many suitable shapes an example of a suitable shape is a disc. The abrasive article can be adapted to remove many different types of materials. Examples of such materials include carbon steel, stainless steel, aluminum, or a polymeric material such as a polymeric surface coating on the workpiece.

EXAMPLES

Objects and advantages of this disclosure are further illustrated by the following non-limiting examples. Particular materials and amounts thereof recited in these examples, however, as well as other conditions and details, should not be construed to unduly limit this disclosure.

The following unit abbreviations are used to describe the examples:

° C.: degrees Centigrade
cm: centimeter
$g/m^2$: grams per square meter
inch: 1 inch=2.54 centimeter
mm: millimeter Unless stated otherwise, all reagents were obtained or are available from chemical vendors such as Sigma-Aldrich Company, St. Louis, Mo., or may be synthesized by known methods. Unless otherwise reported, all ratios and percentages are by weight.

In the Examples that follow, the materials are referred to as follows:

| Abbreviation | Description |
|---|---|
| F1 | Nylon 6,6 500 denier × 76.2 mm staple fibers, obtained as "PN100" from Palmetto Synthetics, LLC, Kingstree, South Carolina |
| F2 | Nylon 6,6 1000 denier × 76.2 mm staple fibers, obtained as "PN101" from Palmetto Synthetics, LLC, Kingstree, South Carolina |
| PU1 | blocked urethane prepolymer, obtained as "ADIPRENE BL16" from Chemtura Corporation, Middlebury , Connecticut |
| PU2 | blocked urethane prepolymer, obtained as "ADIPRENE BL31" from Chemtura Corporation, Middlebury, Connecticut |
| CUR | aromatic amine curative, obtained as "RAC-9907" from Royce international, East Rutherford, New Jersey |
| PMA | propylene glycol monomethyl ether, obtained as "DOWANOL PMA" from Dow Chemical Company, Midland, Michigan |
| PR | a 25M solution of phenoxy resin in 1-methoxy-2-acetopropane, obtained as "INCHEMREZ PKHS" from InChem Corp, Rock Hill, South Carolina |
| OS | organosilane, obtained as "XIAMETER OFS-6040 SILANE" from Dow Chemical Corporation, Midland, Michigan |
| CaCO3 | calcium carbonate, obtained as "HUBERCARB Q325" from Huber Engineered Materials, Quincy, Illinois |
| LiSt | lithium stearate, obtained as "LIC 17" from Baerlocher USA, Cincinnati, Ohio as a 44.1% dispersion in PMA |
| ASIL1 | amorphous silica, obtained as "AEROSIL R202" from Evonik Degussa Corporation USA, Parsippany, New Jersey |
| ASIL2 | amorphous silica, obtained as "CAB-O-SIL M-5" from Cabot Corporation, Cambridge, Massachusetts |
| XYL | xylene, obtained from Toledo Refining Company, LLC, Parsippany, New Jersey |
| BENT | bentonite clay, obtained as "VOLCLAY 325" from American Colloid Company, Arlington Heights, Illinois |

-continued

| Abbreviation | Description |
|---|---|
| CB | carbon black, obtained as "RAVEN 16 POWDER" from Columbian Chemicals Corporation, Marietta, Georgia |
| SURF1 | surfactant, obtained as "TERGITOL XJ" from the Dow Chemical Corporation, Midland, Michigan |
| SURF2 | surfactant, obtained as "TERGITOL 15-S-40" from Dow Chemical Corporation, Midland, Michigan |
| THICK | thickener, obtained as "CARBOPOL EZ3" from the Lubrizol Corporation, Louisville, Kentucky |
| MIN1 | silicon carbide, obtained as "CARBOREX G-21, GRADE 36" from the Washington Mills Corporation, Niagara Falls, New York |
| MIN2 | aluminum oxide, obtained as "ALODUR BFRPL, GRADE 50" from Treibacher Schleifmittel GmbH, Villach, Austria |
| MIN3 | shaped abrasive particles were prepared according to the disclosure of U.S. Pat. No. 8,142,531 (Adefris et al.). The shaped abrasive particles were prepared by molding alumina sol gel in equilateral triangle-shaped polypropylene mold cavities. After drying and firing, the resulting shaped abrasive particles were about 0.88 mm (side length) × 0.18 mm thick, with a draft angle approximately 98 degrees. |
| GEO | antifoam agent, obtained as "GEO FM LTX" from GEO Specialty Chemicals, Ambler, Pennsylvania |

Example 1

A lofty, random air-laid web, having a blend of 40% F1 and 60% F2 at a weight of ~695 g/m$^2$, was formed using an equipment such as that available under the trade designation "RANDO WEBBER" commercially available from Rando Machine Company of Macedon, N.Y. The web was further needle punched in a needle loom, rolled, and a prebond coating having the composition set forth in Table 1 was applied to the air-laid fabric to achieve a dry add-on weight of 251 g/m$^2$. The prebond was then cured in an oven. A make coat precursor having the composition set forth in Table 1 was applied at a dry add-on weight of 649 g/m$^2$ to the pre-bonded air-laid web. Abrasive particles MIN1 were applied to the uncured make coat precursor at an add-on weight of 1435 g/m$^2$ to each side of the make coated web via a particle dropper. The abrasive-coated web was then cured in an oven. A size coat precursor of the composition shown in Table 1 was applied to the abrasive coated web to provide a dry size coat add-on weight of 732 g/m$^2$ and the size coat precursor was subjected to a final cure in an oven.

TABLE 1

| Material | Prebond Coating | Make Coat Precursor | Size Coat Precursor |
|---|---|---|---|
| XYL | — | 18.8% | — |
| PU1 | 36.8% | 51.0% | 12.8% |
| PU2 | — | — | 12.8% |
| CUR | 13.5% | 18.8% | 10.7% |
| PMA | 20.3% | — | 12.8% |
| PR | 22.0% | — | — |
| OS | 0.8% | 1.1% | — |
| CaCO3 | 5.0% | — | — |
| LiSt | — | — | 2.3% |
| ASIL1 | 1.5% | — | — |
| GEO | 0.1% | — | — |
| CB | — | 0.6% | — |
| BENT | — | 8.3% | — |
| SURF1 | — | — | 0.7% |
| SURF2 | — | — | 0.7% |
| THICK | — | — | 0.1% |
| water | — | — | 47.1% |
| ASIL2 | — | 1.4% | — |

Example 2

A lofty, random air-laid web, having a blend of 40% F1 and 60% F2 at a weight of ~695 g/m$^2$, was formed using a "RANDO WEBBER" equipment. The web was further needle punched in a needle loom, rolled, and a prebond coating having the composition set forth in Table 1 was applied to the air-laid fabric to achieve a dry add-on weight of 251 g/m$^2$. The prebond was then cured in an oven. A make coat precursor having the composition set forth in Table 1 was applied at a dry add-on weight of 645 g/m$^2$ to the prebonded air-laid web. Abrasive particles consisting of 25% MIN1, 50% MIN2 and 25% MIN3 were applied to the uncured make coat precursor at an add-on weight of 1812 g/m$^2$ to each side of the make coated web via a particle dropper. The abrasive-coated web was then cured in an oven. A size coat precursor of the composition shown in Table 1 was applied to the abrasive coated web to provide a dry size coat add-on weight of 879 g/m$^2$ and the size coat precursor was subjected to a final cure in an oven.

Comparative Example A

Comparative Example A was a commercially available non-woven cleaning and stripping material having the trade designation "SCOTCH-BRITE CLEAN AND STRIP DISC" available from the Minnesota Mining and Manufacturing Company of St. Paul, Minn. This product contains silicon carbide as the functioning abrasive.

Comparative Example B

Comparative Example B was a commercially available non-woven cleaning and stripping material having the trade designation "NORTON BLAZE RAPID STRIP DISC XCRS SG" available from the Saint-Gobain Norton Abrasives, Worchester, Mass. This product contains ceramic mineral as the functioning abrasive.

Test Procedure for Edge Cut and Wear:

Pre-weighed 4 inch (10.16 cm)×11 inch (27.94 cm) 304 stainless steel, 16 gauge screen with staggered 0.187 inch (4.75 mm) round perforations on 0.25 inch (6.35 mm) centers acting as a workpiece were mounted on a carriage. The carriage was brought horizontally against a 203 mm (8 inch) rotating test disc such that the discs contacted the test specimen at a force of 22.2 newtons (5 pound-force). The carriage was oscillated tangentially up and down with a stroke length of 152 mm (6 inch) and a stroke speed of 76 mm (3.0 inch) per second. Contact between the rotating test disc and screen workpiece was maintained for 10 seconds, after which time contact was removed for 10 seconds. This sequence was repeated 12 times during a test sequence, after which time the weight loss of the disc test specimen and workpiece were determined. The test sequence was repeated six times for a total contact time between the disc and the workpiece of 10 minutes. The arbor of the mechanically driven, variable speed lathe was adjusted to generate a test speed of 2500 rpm (or 5230 surface feet per minute) at the outer edge of the 8 inch discs. One disc approximately 203 mm (8 inch) in diameter with a 31.75 mm (1.25 inch) center hole and 16.5 mm (0.650 inch), thick was mounted on the arbor. The total of the weight loss of the disc was calculated and divided by the original disc weight and reported as wear percent. The total of the weight loss of the screen was calculated and reported as cut.

Examples 1, 2 and Comparative Examples A, B were tested and the results are listed in Table 2.

Test Procedure for Face Cut and Wear:

A 4.5 inch (11.43 cm) diameter nonwoven abrasive disc to be tested was mounted on an electric rotary tool that was disposed over an X-Y table having a phenolic panel measuring 15 inches×21 inches×1 inch (381 mm×356 mm×25.4 mm) secured to the X-Y table. The phenolic panel was obtained under the trade designation "XXC-1-S" from Plastics International, Eden Prairie, Minn. The tool was set to traverse at a rate of 14 inches per second (355.6 mm per second) in the Y direction along the length of the panel; and a traverse along the width of the panel at a rate of 5 inches per second (127 mm per second). Fourteen such passes along the length of the panel were completed in each cycle for a total of 4 cycles. The rotary tool was activated to rotate at 10000 rpm under no load. The abrasive article was then urged at an angle of 5 degrees against the panel at a load of 6 pounds (2.73 kilograms). The tool was then activated to move through the prescribed path. The mass of the panel was measured before and after each cycle to determine the total mass loss in grams after each cycle, a cumulative mass loss was determined at the end of 4 cycles and reported as cut. The disc was weighed before and after the completion of the test (4 cycles) to determine the wear.

Examples 1, 2 and Comparative Examples A, B were tested and the results are listed in Table 2.

TABLE 2

| | Measured Deflection (inches) | | Edge Test | | Face Test | |
|---|---|---|---|---|---|---|
| Sample | at 10 pounds | at 100 pounds | Cut (grams) | Wear (%) | Cut (grams) | Wear (%) |
| Comparative Example A | 0.035 | 0.076 | 9.0 | 10 | 59 | 17 |
| Example 1 | 0.091 | 0.186 | 7.6 | 2 | 73 | 11 |
| Comparative Example B | 0.018 | 0.049 | 15.2 | 3 | 63 | 1 |
| Example 2 | 0.088 | 0.187 | 15.0 | 2 | 86 | 2 |

Table 2 shows the measured deflection of the abrasive at 10 pounds and 100 pounds force applied to a 3 inch (6.93 cm) circular disc, corresponding cut and wear on the product edge on stainless steel screen, and cut and wear on the linen phenolic on the product face. Example 1 was a silicon carbide containing sample to show high deflection, low wear percentages, a lower cut rate on the edge but a higher cut rate on the face, compared to Comparative Example A. Similarly, Example 2 was an aluminum oxide containing sample showing high deflection, similar cut rate on the edge, low wear percentages but higher cut rate on the face, compared to Comparative Example B.

Example 1 prepared by this method with silicon carbide mineral exhibited a high degree of conformability and an open, porous surface as compared to the comparative examples all containing silicon carbide mineral. This open non-planar surface provided fresh exposure of mineral along the fibers and a porous surface to prevent loading of swarf into the non-woven abrasive during use. The Comparative Example A and Example 1 had similar performance on the edge with Example 1 providing superior performance on the face of the abrasive with the open non-planar surface.

Example 2 prepared by this method with an abrasive mineral blend exhibited a high degree of conformability and an open, porous surface as compared to the comparative example containing ceramic mineral. This open non-planar surface provided fresh exposure of mineral along the fibers and a porous surface to prevent loading of swarf into the non-woven abrasive during use. The Comparative Example B and Example 2 had similar performance on the edge with Example 2 providing superior performance on the face of the abrasive with the open non-planar surface.

Example 3: Effect of Fiber Length on Web Strength

An 18-inch wide, 605 g/m$^2$ nonwoven web was prepared from a blend of 60% F1 and 40% F2 nylon staple fibers of the fiber lengths shown in Table 3 using a "RANDO WEBBER" air lay machine at 5 feet (1.52 meters) per minute. Process settings were varied within normal operating parameters to create a nonwoven web. The web was passed over the end of a conveying belt and the suspended weight of web was recorded at break for the conditions specified in Table 3.

The crimps per inch were measured per ASTM D3937-12 "Crimp Frequency of Manufactured Staple Fibers". The crimp index was reported as the difference of the extended fiber length minus the relaxed fiber length divided by the extended fiber length expressed as a percentage in Table 3. ASTM D5103-07 "Length and Length Distribution of Manufactured Staple Fibers" was used to determine the extended fiber length. The relaxed length was measured as the longest distance between the fiber ends in a relaxed fiber state.

TABLE 3

| | | | |
|---|---|---|---|
| Fiber Length | 2 inches | 3 inches | 3 inches |
| Crimp Index | 22-38% | 25-40% | 48-58% |
| Crimps per inch | 1.4-1.9 | 1.1-1.6 | 1.2-1.6 |
| Break Off Weight | 971 grams | 2623 grams | Not able to Process |

The web made from 3-inch fiber demonstrated a significantly higher break weight strength than the web made from 2-inch fiber. This increase in web strength occurred as longer fibers created more entanglement in the nonwoven web resulting in increased web strength. Necessary for subsequent processes is sufficient web strength to transfer gaps between rolls, belts and pass through typical roll coaters used in the nonwoven coating process. It was found nonwoven webs made with web strengths below about 1000 grams would elongate and come apart during subsequent processing. The importance of crimp index was found in an attempt to process 3 inch long fibers with crimp indexes of 48-58%. At this crimp level the degree of entanglement of the fibers prevented feeding of the fiber through the "RANDO WEBBER" machine and resulted in plugging and unexpected stopping of the equipment. As a result it was found that sufficiently strong web for further nonwoven abrasive processing required fiber lengths greater than 2 inches and less than approximately 4 inches with crimp indexes between about 20 and 40% to prevent machine stoppages.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present disclosure. Thus, it should be understood that although the present disclosure has been specifically disclosed by specific embodiments and optional features, modification and variation of the concepts herein disclosed may be resorted to by those of ordinary skill in the art, and that such modifications and variations are considered to be within the scope of embodiments of the present disclosure.

Additional Embodiments

The following exemplary embodiments are provided, the numbering of which is not to be construed as designating levels of importance:

Embodiment 1 provides an abrasive article comprising:

a nonwoven web comprising:

a first irregular major surface and an opposite second irregular major surface;

a fiber component comprising staple fibers having a linear density ranging from about 50 denier to about 2000 denier and a crimp index value ranging from about 15% to about 60%;

a binder dispensed on the fiber component; and abrasive particles dispersed throughout the nonwoven web.

Embodiment 2 provides the abrasive article of Embodiment 1, wherein the fiber component ranges from about 5 wt % to about 30 wt % of the abrasive article.

Embodiment 3 provides the abrasive article according to any one of Embodiments 1 or 2, wherein the fiber component ranges from about 10 wt % to about 25 wt % of the abrasive article.

Embodiment 4 provides the abrasive article according to any one of Embodiments 1-3, wherein the staple fibers range from about 70 wt % to about 100 wt % of the fiber component.

Embodiment 5 provides the abrasive article according to any one of Embodiments 1-4, wherein the staple fibers range from about 90 wt % to about 100 wt % of the fiber component.

Embodiment 6 provides the abrasive article according to any one of Embodiments 1-5, wherein the staple fibers have a length ranging from about 35 mm to about 155 mm.

Embodiment 7 provides the abrasive article according to any one of Embodiments 1-6, wherein the staple fibers have a length of about 70 mm to about 80 mm.

Embodiment 8 provides the abrasive article according to any one of Embodiments 1-7, wherein the staple fibers have a linear density ranging from about 50 denier to about 600 denier.

Embodiment 9 provides the abrasive article according to any one of Embodiments 1-8, wherein the staple fibers have a linear density ranging from about 400 denier to about 1000 denier.

Embodiment 10 provides the abrasive article according to any one of Embodiments 1-9, wherein a crimp index value of the staple fibers ranges from about 20% to about 40%.

Embodiment 11 provides the abrasive article according to any one of Embodiments 1-10, wherein the fiber component comprises:

a first plurality of the staple fibers; and a second plurality of the staple fibers, wherein at least one of the linear density, the crimp index, and a length of the first plurality of staple fibers differs from the linear density, the crimp index, and a length of the second plurality of staple fibers.

Embodiment 12 provides the abrasive article of Embodiment 11, wherein the first plurality of staple fibers ranges from about 5 wt % to about 80 wt % of the fiber component.

Embodiment 13 provides the abrasive article of Embodiment 11, wherein the second plurality of staple fibers ranges from about 20 wt % to about 95 wt % of the fiber component.

Embodiment 14 provides the abrasive article of Embodiment 11, wherein the linear density of the first plurality of staple fibers ranges from about 50 denier to about 500 denier.

Embodiment 15 provides the abrasive article of Embodiment 11, wherein the linear density of the second plurality of staple fibers ranges from about 500 denier to about 2000 denier.

Embodiment 16 provides the abrasive article of Embodiment 11, wherein the ratio of the linear density of the first plurality of staple fibers to the linear density of the second plurality of staple fibers is less than about 1:2.

Embodiment 17 provides the abrasive article according to any one of Embodiments 1-16, wherein the fibers are entangled with respect to each other.

Embodiment 18 provides the abrasive article according to any one of Embodiments 1-17, wherein the staple fibers are randomly oriented and adhesively bonded together at points of mutual contact.

Embodiment 19 provides the abrasive article according to any one of Embodiments 1-18, wherein the staple fibers are chosen from a polyester, a nylon, a polypropylene, an acrylic, a rayon, a cellulose acetate, a polyvinylidene chloride-vinyl chloride copolymer, a vinyl chloride-acrylonitrile copolymer, and combinations thereof.

Embodiment 20 provides the abrasive article according to Embodiment 19, wherein the nylon is nylon-6,6.

Embodiment 21 provides the abrasive article according to any one of Embodiments 1-20, wherein the abrasive particles range from about 5 wt % to about 70 wt % of the abrasive article.

Embodiment 22 provides the abrasive article according to any one of Embodiments 1-21, wherein the abrasive particles are formed ceramic abrasive particles.

Embodiment 23 provides the abrasive article of Embodiment 22, wherein the formed abrasive particles include triangular shaped abrasive particles.

Embodiment 24 provides the abrasive article of Embodiment 21, wherein the abrasive particles include crushed abrasive particles.

Embodiment 25 provides the abrasive article of any one of Embodiments 1-24, wherein the abrasive particles comprise a material chosen from an alpha-alumina, a fused aluminum oxide, a heat-treated aluminum oxide, a ceramic aluminum oxide, a sintered aluminum oxide, a silicon carbide, a titanium diboride, a boron carbide, a tungsten carbide, a titanium carbide, a diamond, a cubic boron nitride, a garnet, a fused alumina-zirconia, a sol-gel derived abrasive particle, a cerium oxide, a zirconium oxide, a titanium oxide, and combinations thereof.

Embodiment 26 provides the abrasive article of any one of Embodiments 1-25, wherein the abrasive particles comprise a material chosen from silicon carbide, aluminum oxide and combinations thereof.

Embodiment 27 provides the abrasive article of any one of Embodiments 1-26, wherein the plurality of abrasive particles are at least one of individual abrasive particles and agglomerates of abrasive particles.

Embodiment 28 provides the abrasive article according to any one of Embodiments 1-27, wherein the abrasive article is a wheel.

Embodiment 29 provides the abrasive article according to any one of Embodiments 1-28, wherein at least one of the first major surface and the second major surface are substantially free of planar agglomerations of the fibers.

Embodiment 30 provides the abrasive article according to any one of Embodiments 1-29, wherein the abrasive article is a non-compressed abrasive article.

Embodiment 31 provides the abrasive article according to any one of Embodiments 1-30, wherein the binder is chosen from a polyurethane resin, a polyurethane-urea resin, an epoxy resin, a urea-formaldehyde resin, a phenol-formaldehyde resin, and combinations thereof.

Embodiment 32 provides the abrasive article according to any one of Embodiments 1-31, wherein the binder ranges from about 10 wt % to about 70 wt % of the abrasive article.

Embodiment 33 provides a method of making the abrasive article of any one of Embodiments 1-32, comprising:

forming a web of the staple fibers;

perforating the web;

applying the abrasive particles and the binder to the perforated web; and curing the binder, to provide the abrasive article.

Embodiment 34 provides the method of Embodiment 33, wherein the abrasive particles are applied to the first and second major surfaces.

Embodiment 35 provides the method according to any one of Embodiments 33 or 34, wherein the abrasive particles are drop-coated to the first and second major surfaces.

Embodiment 36 provides the method according to any one of Embodiments 33-35, wherein the abrasive particles are applied to the web at an add-on weight ranging from about 100 g/m$^2$ to about 5000 g/m$^2$.

Embodiment 37 provides the method according to any one of Embodiments 33-36, wherein the abrasive particles are applied to the web at an add-on weight ranging from about 2000 g/m$^2$ to about 4000 g/m$^2$.

Embodiment 38 provides the method according to any one of Embodiments 33-36, wherein forming the web of fibers comprises air-laying the staple fibers.

Embodiment 39 provides the method of Embodiment 38, wherein the staple fibers are air laid with a web-forming machine.

Embodiment 40 provides the method of Embodiment 39, wherein a portion of the fibers are less likely to plug the web-forming machine than corresponding fibers differing with respect to at least one of length, crimp index, and linear density.

Embodiment 41 provides a method for removing material from the surface of a workpiece, the method comprising:

contacting an abrasive article according to any one of Embodiments 1-32 or formed according to the method of any one of Embodiments 33 to 40, against the workpiece; and moving the abrasive article relative to the workpiece while maintaining pressure between the abrasive article and the workpiece surface to remove material therefrom.

Embodiment 42 provides the method according to Embodiment 41, wherein the abrasive article is in the shape of a disc having a center axis and moving the abrasive article relative to the workpiece is accomplished by rotating the abrasive article about the center axis.

Embodiment 43 provides the method according to any one of Embodiments 41 to 42, wherein the material removed from the workpiece is carbon steel.

Embodiment 44 provides the method according to any one of Embodiments 41 to 43, wherein the material removed from the workpiece is a polymeric surface coating.

Embodiment 45 provides an abrasive article comprising:

a nonwoven web comprising:

a first irregular major surface and an opposite second irregular major surface;

a fiber component comprising a blend of first staple fibers having a linear density ranging from about 50 denier to about 600 denier and second staple fibers having a linear density ranging from about 500 denier to about 1000 denier, silicon carbide abrasive particles distributed on the fiber component; and a binder distributed on the fiber component.

What is claimed is:

1. An abrasive article comprising:

a nonwoven web comprising:

a first irregular major surface and an opposite second irregular major surface, wherein one of the first and second irregular major surfaces comprise a non-planar contour;

a fiber component comprising staple fibers having a linear density ranging from about 50 denier to about 2000 denier and a crimp index value ranging from about 20% to about 40%;

a binder dispensed on the fiber component; and abrasive particles dispersed throughout the nonwoven web;

wherein the staple fibers comprise a first plurality of smaller denier fibers having a linear density ranging from 50 denier to 500 denier and a second plurality of larger denier fibers having a linear density ranging from greater than 800 denier and up to 2000 denier; and wherein at least one of the first irregular major surface and the second irregular major surface are substantially free of planar agglomerations of the fibers.

2. The abrasive article of claim 1, wherein the fiber component ranges from about 5 wt % to about 30 wt % of the abrasive article.

3. The abrasive article according to claim 1, wherein the fiber component ranges from about 10 wt % to about 25 wt % of the abrasive article.

4. The abrasive article according to claim 1, wherein the staple fibers range from about 70 wt % to about 100 wt % of the fiber component.

5. The abrasive article according to claim 1, wherein the staple fibers have a length ranging from about 35 mm to about 155 mm.

6. The abrasive article according to claim 1, wherein at least one of the crimp index and a length of the first plurality of staple fibers differs from the crimp index and a length of the second plurality of staple fibers.

7. The abrasive article according to claim 1, wherein the fibers are entangled with respect to each other.

8. The abrasive article according to claim 1, wherein the staple fibers are randomly oriented and adhesively bonded together at points of mutual contact.

9. The abrasive article according to claim 1, wherein the staple fibers are chosen from a polyester, a nylon, a polypropylene, an acrylic, a rayon, a cellulose acetate, a polyvinylidene chloride-vinyl chloride copolymer, a vinyl chloride-acrylonitrile copolymer, and combinations thereof.

10. The abrasive article of claim 1, wherein the abrasive particles are at least one of individual abrasive particles and agglomerates of abrasive particles.

11. The abrasive article according to claim 1, wherein the abrasive article is a wheel.

12. The abrasive article according to claim 1, wherein the abrasive article is a non-compressed abrasive article.

13. A method of making the abrasive article of claim 1, comprising:

forming a web of the staple fibers;

perforating the web;

applying the abrasive particles and the binder to the perforated web; and curing the binder, to provide the abrasive article.

14. The method of claim 13, wherein the abrasive particles are applied to the first and second irregular major surfaces.

15. A method for removing material from the surface of a workpiece, the method comprising:

contacting an abrasive article according to claim 1 against the workpiece; and moving the abrasive article relative to the workpiece while maintaining pressure between the abrasive article and the workpiece surface to remove material therefrom.

* * * * *